United States Patent [19]

Howe et al.

[11] Patent Number: 5,048,287

[45] Date of Patent: Sep. 17, 1991

[54] TUNED EXHAUST PROCESSOR ASSEMBLY

[75] Inventors: Michael G. Howe; James C. Arthur; Robert T. Usleman, all of Columbus, Ind.

[73] Assignee: Arvin Industries, Inc., Columbus, Ind.

[21] Appl. No.: 541,083

[22] Filed: Jun. 19, 1990

Related U.S. Application Data

[63] Continuation of Ser. No. 232,023, Aug. 15, 1988, abandoned.

[51] Int. Cl.[5] ..... F01N 3/02

[52] U.S. Cl. ..... 60/288; 55/276; 55/313; 55/314; 55/466; 55/DIG. 30; 60/299; 60/311; 181/231; 181/256; 181/272

[58] Field of Search ..... 60/299, 288, 311; 181/231, 252, 255, 256, 264, 265, 272; 55/276, 312, 313, 314, 466, DIG. 30

[56] References Cited

U.S. PATENT DOCUMENTS

| | | | |
|---|---|---|---|
| 2,947,600 | 8/1960 | Clayton . | |
| 2,956,865 | 10/1960 | Williams . | |
| 3,090,677 | 5/1963 | Scheitlin et al. . | |
| 3,180,712 | 4/1965 | Hamblin . | |
| 3,445,196 | 5/1969 | Thomas . | |
| 3,503,714 | 3/1970 | Lang . | |
| 3,712,030 | 1/1973 | Priest . | |
| 3,841,841 | 10/1974 | Torosian | 55/313 |
| 4,124,091 | 11/1978 | Mizusawa | 181/231 |
| 4,175,107 | 11/1979 | Iwaoka et al. . | |
| 4,264,344 | 4/1981 | Ludecke | 55/313 |
| 4,386,497 | 6/1983 | Takagi et al. . | |
| 4,478,618 | 10/1984 | Bly | 55/314 |
| 4,505,106 | 3/1985 | Frankenberg et al. . | |
| 4,512,147 | 4/1985 | Wong . | |
| 4,558,565 | 12/1985 | Kojima | 55/312 |
| 4,625,511 | 12/1986 | Scheitlin et al. . | |
| 4,651,524 | 3/1987 | Brighton . | |
| 4,665,692 | 5/1987 | Inaba | 181/254 |

FOREIGN PATENT DOCUMENTS

| | | |
|---|---|---|
| 2247947 | 4/1974 | Fed. Rep. of Germany . |

*Primary Examiner*—Douglas Hart
*Attorney, Agent, or Firm*—Barnes & Thornburg

[57] ABSTRACT

An exhaust processor is provided for filtering particulate matter from a combustion product. The exhaust processor includes a housing providing a main passageway having a substrate mounted therein for solid particle filtration. The housing also provides an auxiliary passageway containing a muffler for attenuating noise of combustion product. Combustion product is diverted through the auxiliary passageway after the substrate collects a predetermined amount of solid particles from combustion product to permit regeneration of the substrate by a burner.

29 Claims, 2 Drawing Sheets

TUNED EXHAUST PROCESSOR ASSEMBLY

This application is a continuation of application Ser. No. 232,023, filed Aug. 15, 1988, and now abandoned.

BACKGROUND AND SUMMARY OF THE INVENTION

This invention relates to exhaust processors for filtering particulate matter from a combustion product, and particularly to an exhaust processor having a by-passable filter regeneration system. More particularly, the present invention relates to an exhaust processor assembly with a processor housing providing a main passageway through the housing having a substrate mounted therein for solid particle filtration and an auxiliary passageway through the housing bypassing the substrate and containing a muffler for attenuating noise of combustion product diverted through the auxiliary passageway during regeneration.

It is well known in the art to employ a diesel particulate trap which filters combustion product from an engine by passing the combustion product through a filter element or substrate to remove solid particles and pollutants before the combustion product is released to the atmosphere. These substrates must periodically be cleaned to restore functionality to the trap. Heat is applied to each substrate to burn and oxidize trapped carbon particles removed from the combustion product in the substrate. During this cleansing or "regeneration" it is advantageous to divert the combustion product through an auxiliary passageway bypassing the substrate to allow regeneration of the substrate by a burner or heat source.

One object of the present invention is to incorporate a muffler into an exhaust processor assembly to meet acceptable noise standards by attenuating exhaust noise and also to provide an obstacle to easy disablement of an exhaust filter in the assembly by tampering with the exhaust filter while leaving the muffler in a functioning state.

Another object of the present invention is to provide muffler means, situated in a flow passage bypassing an exhaust filter, for attenuating noise produced by the exhaust as it is diverted through the bypass flow passage during regeneration of the filter.

Yet another object of the present invention is to provide a single housing including means for treating a combustion product and means for attenuating noise from the combustion product during regeneration of the treating means.

Still another object of the invention is to house an exhaust filter, substrate, or other combustion product treatment means in one flow passage of an exhaust process or assembly and an acoustic muffling device or other noise attenuation means in a second flow passage of the exhaust process or assembly.

A further object of the invention is to divide an upstream portion of an exhaust processor housing into a first flow passage containing a substrate and a second flow passage bypassing the substrate and place a muffler in a downstream portion of the housing to receive combustion product from both of the first and second flow passages before the combustion product is discharged from the housing so that noise of combustion product conducted through either a main or substrate bypass passage is attenuated by a muffler in the housing.

According to the present invention, an exhaust processor assembly includes a housing having an inlet for introducing combustion product from the housing and an outlet for discharging the combustion product from the housing. A partition is positioned within the housing to define first and second passageway means or flow passages extending through the housing to provide communication between the inlet and the outlet. A substrate is situated in the first flow passage. The substrate collects particulate matter entrained in the combustion product as the combustion product passes through the first flow passage. A muffler is situated in the second flow passage to attenuate noise generated by combustion product passing through the second flow passage.

In preferred embodiments, a top shell and a complementary bottom shell are joined together to form the housing. The partition includes an outer flange trapped between portions of the top and bottom shells to secure the partition in its position within the housing. The partition and top shell cooperate to define a portion of the second flow passage, and the partition and the bottom shell cooperate to define a portion of the first flow passage.

The muffler extends between the partition and the top shell to provide means for reversing the direction of combustion product flow to attenuate noise generated by the combustion product. The reversing means includes a plurality of baffles interconnecting the top shell and the partition to define a plurality of chambers. At least two tubes are configured to interconnect selected chambers to define means for conducting combustion product through the muffler toward the outlet.

According to other preferred embodiments of the present invention, the top and bottom shells cooperate to define a third flow passage interconnecting the first and second flow passages and the housing outlet. The muffler is situated in the third flow passage. The muffler includes a plurality of baffles interconnecting the top and bottom shells to define a plurality of muffler chambers in the third flow passage. The muffler further includes a plurality of first tubes arranged to extend through the baffles to define means interconnecting selected muffler chambers for communicating combustion product from the second flow passage to the housing outlet.

In one of such other embodiments, the muffler includes a second tube arranged to extend through the baffles to interconnect the first flow passage and the housing outlet without introducing combustion product passing through the first flow passage into any of the muffler chambers. In another of such other embodiments, the second tube is perforated or otherwise formed to include means for communicating combustion product passing therethrough to at least one of the muffler chambers.

One feature of the present invention is that a muffler is situated in the passageway bypassing the substrate. Advantageously, this muffler acts to attenuate noise generated by combustion product passing therethrough during regeneration of the substrate.

Another feature of each of the embodiments is the provision of a muffler and a substrate for treating combustion product from an engine in a single housing. The likelihood that someone will attempt to disable or circumvent the substrate is substantially reduced because of inclusion of the substrate and the muffler in a single housing. Location of the substrate inside the muffler housing makes it difficult for a mechanic or vehicle owner to disable the substrate without damaging the housing and muffler. Any damage to the muffler could cause the vehicle not to comply with mandatory vehicle noise emission standards. Thus, it is unlikely that someone would choose to sacrifice the muffler and housing to circumvent the substrate. Advantageously, such a system will help to ensure that untreated combustion product will not be discharged into the environment because of intentional tampering with vehicle pollution control systems.

Yet another feature of the invention is the provision of a muffler subassembly that extends from an inner wall of the top shell to an inner wall of the bottom shell of the housing. Advantageously, such a feature utilizes the maximum spatial volume available within the housing for the muffler, thereby increasing sound attenuation of the combustion product bypassing the substrate during regeneration.

Still another feature of the invention is the provision of apertures in the vent tubes extending through the muffler subassembly from the substrate to the outlet means. Combustion product passing through the vent tubes can enter at least one of the chambers in the muffler. Advantageously, such a configuration increases attenuation of combustion product passing from the substrate to the outlet. Reversing flow of combustion product through the apertures permits the utilization of the volume in the muffler subassembly to further attenuate combustion product exiting the substrate.

In this specification and in the claims, the words "an exhaust processor" are intended to refer to various types of catalytic convertors and processors, diesel particulate filters, and other particulate traps in connection with which the invention may be used.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
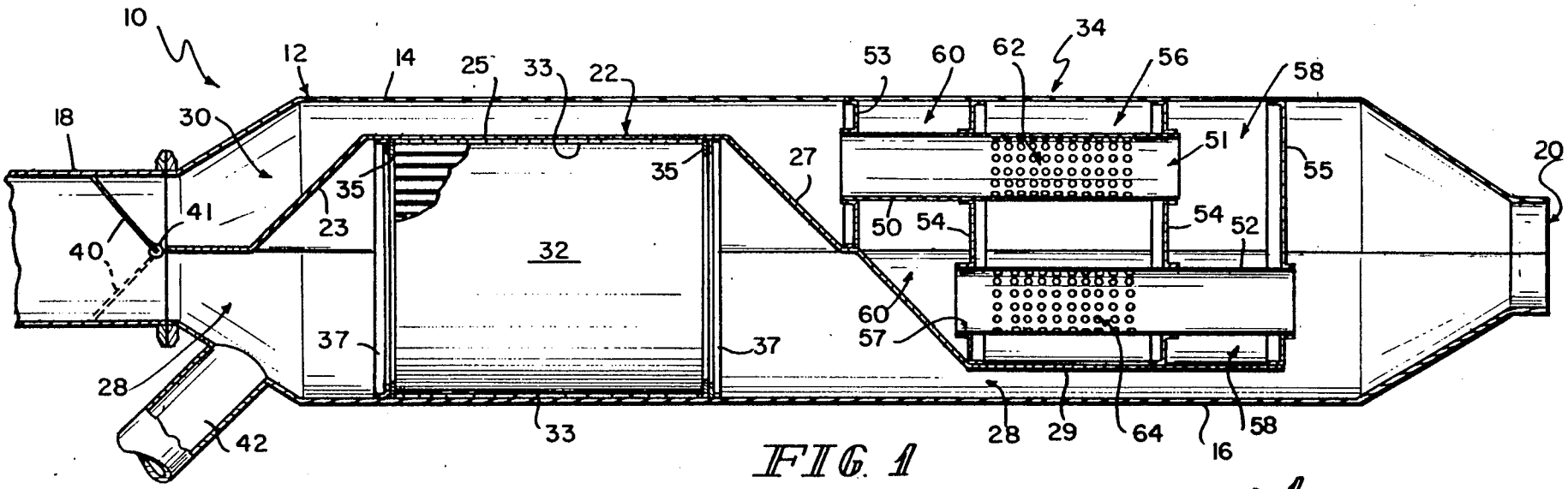
FIG. 1 is a sectional view of an exhaust processor, taken along lines 1—1 of FIG. 3, with portions broken away, incorporating one of the preferred embodiments of the present invention.

Exhaust exits an engine or any other means (not shown) which produces a combustion product containing noxious pollutants or solid particles. The exhaust is passed from the engine (not shown) to the inlet of an exhaust processor assembly 10, 210, or 310 through an inlet pipe 18 or other suitable means. Each of these assemblies 10, 210, and 310 comprise one of the preferred embodiments of the present invention.

An exhaust processor assembly 10 of the present invention includes a housing 12 of the clamshell type including a top or upper half shell 14 and a bottom or lower half shell 16. The housing 12 further includes an inlet 18 to receive combustion product from an engine (not shown), and an outlet 20 for exhausting combustion product from the housing 12. A partition 22 is located inside the housing 12 to define a first region or first flow passage 28 and a second region or second flow passage 30 inside the housing. The partition 22 is a three dimensional, thin-walled, sheet metal stamping and is constructed to include an inlet cone section 23, a first body section 25, a transition section 27, and a second body section 29.

Figure 3:
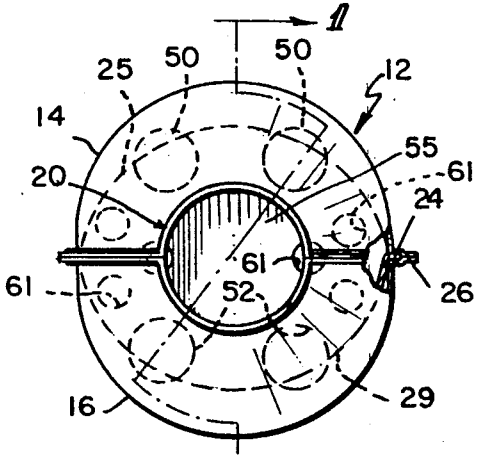
FIG. 3 is an end elevational view of the exhaust processor shown in FIG. 1 taken at the outlet end of the exhaust processor.
Figure 2:
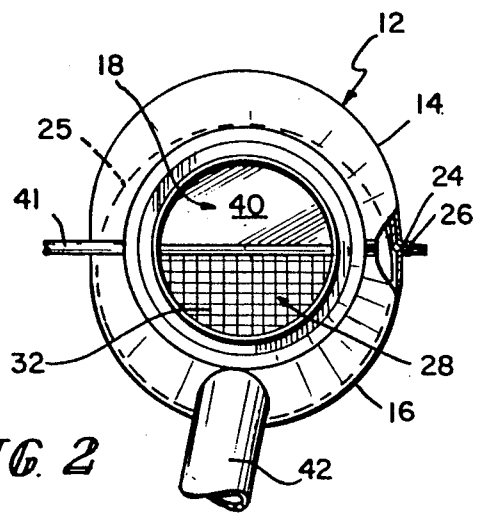
FIG. 2 is an end elevational view of the exhaust processor shown in FIG. 1 taken at the inlet end of the exhaust processor.

The partition 22 is secured inside the housing 12 to divide the interior region of assembly 10 into the flow passages 28 and 30. As best shown in FIGS. 2 and 3, peripheral flange 24 of partition 22 is trapped between the outer flanges 26 of the upper half shell 14 and lower half shell 16 to secure the partition 22 in a proper position inside housing 12.

A substrate 32 is positioned in the first flow passage 28 in close proximity to inlet 18. The substrate 32 is illustratively a cylindrically shaped monolithic cellular structure of conventional diameter and length. Of course, substrate 32 could be any suitable shape. The substrate is supported in its proper position by any conventional support means such as mat 33. End seals 35 provide a seal between the substrate 32 and the wall of first flow passage 28. Retaining rings 37 hold substrate 32, mat 33, and end seals 35 in proper positions within the first flow passage 28. This arrangement insures that all the combustion product entering the first flow passage 28 will pass through substrate 32 by creating an impenetrable seal between the substrate 32 and an inner wall of first flow passage 28.

A muffler subassembly 34 is positioned in the second flow passage 30 of housing 12 in close proximity to the outlet 20 of housing 12. The muffler subassembly 34 acoustically tunes combustion product passing through the second flow passage 30 during regeneration of the substrate 32.

In the embodiment shown in FIG. 1, a bypass valve 40 pivotally coupled to housing 12 at location 41 directs flow of combustion product from the engine (not shown) into either the first flow passage 28 or the second flow passage 30 of housing 12. During normal operation, valve 40 is situated in a first valve position as shown in FIG. 1 to direct flow of the combustion product through the first flow passage 28 and into substrate 32 to treat the combustion product. As the combustion product exits substrate 32, it continues to move through the first flow passage 28 and is exhausted from the housing 12 through outlet 20. The substrate 32 removes solid particles and other pollutants from the combustion product.

Filtering efficiency of the substrate 32 decreases significantly once the substrate is clogged and saturated with solid particles entrained in the combustion product. Therefore, the substrate 32 must periodically be cleaned to restore its functionality. To clean substrate 32, heat is applied to the substrate 32 by activating a burner (not shown) through burner inlet 42 to burn and oxidize trapped carbon particles, thereby regenerating substrate 32.

During regeneration of substrate 32 it is advantageous to divert incoming combustion product away from substrate 32 to enhance particle burning and oxidizing activity in the substrate 32. The valve 40 is moved to a second valve position (dotted position shown in FIG. 1) by control means (not shown) to direct flow of the combustion product into the second flow passage 30 of the housing 12 before regeneration of substrate 32 begins and after the filtering efficiency of substrate 32 drops below a selected level. The combustion product therefore bypasses the substrate 32 and passes through muffler subassembly 34 located in the second flow passage 30 of housing 12. Once regeneration of substrate 32 is complete, the valve 40 is returned to the first valve position to direct the combustion product emitted from the engine into first flow passage 28 and into substrate 32 for treatment therein.

Muffler subassembly 34 includes inlet tubes 50 and outlet tubes 52. A plurality of baffles 53, 54, and 55 are used to secure the inlet tubes 50 and outlet tubes 52 inside the second flow passage 30 between the partition 22 and the housing 12. The configuration and orientation of inlet tubes 50 and outlet tubes 52 inside the housing 12 is illustrated in FIGS. 1 and 3.

The baffles 53, 54, and 55 are configured and positioned to define an expansion chamber 56, a first resonator chamber 58, and a second resonator chamber 60. Upstream baffle 54 includes at least one aperture means 61 for allowing a flow of combustion product to reach chamber 60. Combustion product enters the muffler subassembly 34 through inlet tubes 50 and is conducted into expansion chamber 56 via inlet tubes 50 and apertures 62 formed therein without communicating with combustion product in second resonator chamber 60. The combustion product then travels through a central region of chamber 56 and enters outlet tubes 52 through apertures 64. It then flows through outlet tubes 52 without communicating with combustion product in first resonator chamber 58 and is exhausted through outlet 20 of housing 12. Some of the combustion product enters either the first resonator chamber 58 through openings 51 of tubes 50 or the second resonator chamber 60 either through opening 57 of tubes 52 or flow through holes 61 in baffles 54. These holes 61 are provided in each baffle 54 to allow flow from chamber 58 to chamber 60 through chamber 56 on its way to outlet 20 through exit tubes 52. The resonator chambers 58 and 60 further attenuate the low frequency components of the combustion product.

Figures 4, 5, 6:
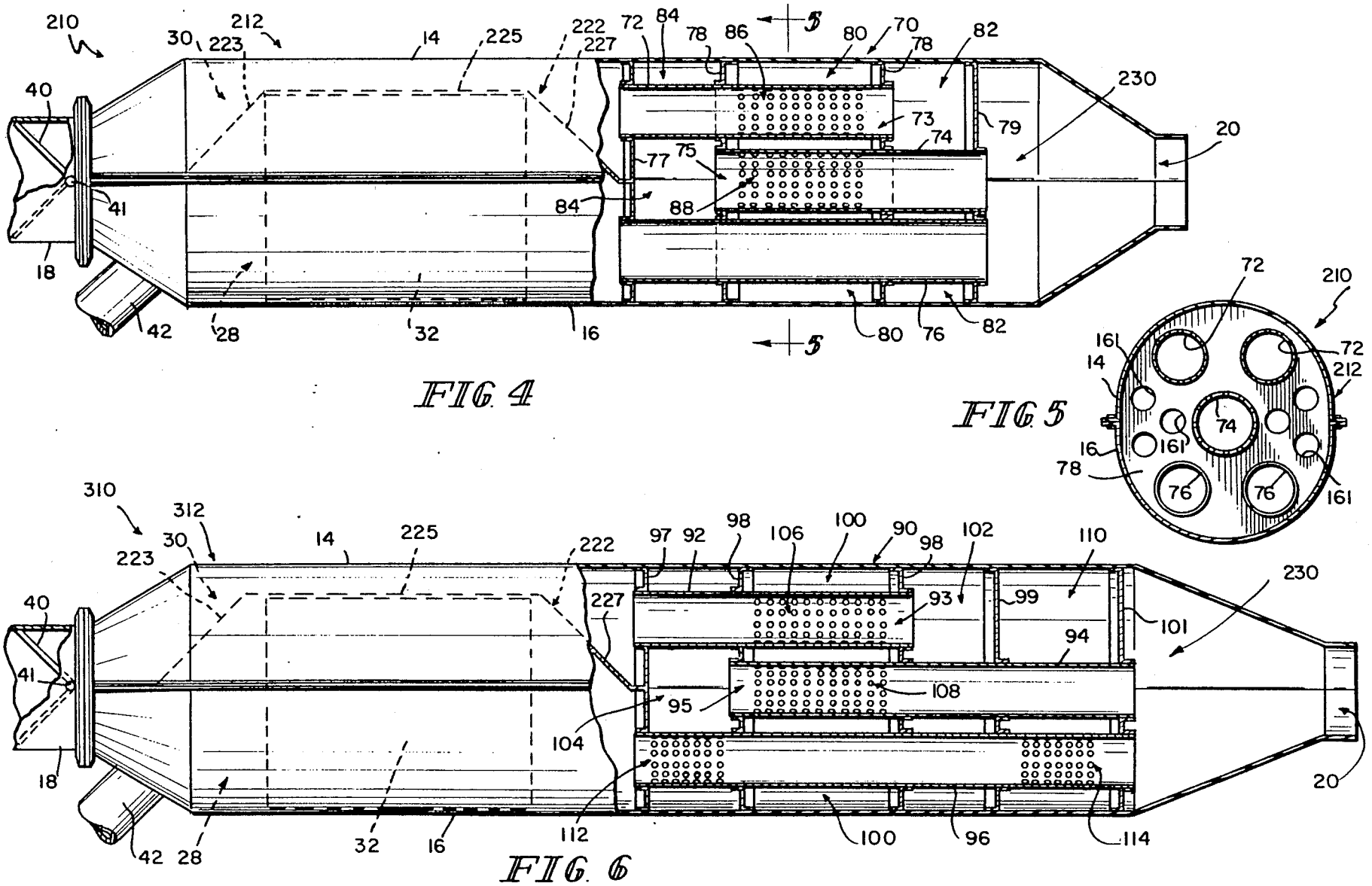
FIG. 4 is a side elevational view of a second embodiment of the present invention, with portions broken away to reveal detail of the muffler.
FIG. 5 is a transverse cross-sectional of the exhaust processor assembly shown in FIG. 4, taken along lines 5—5 of FIG. 4.
FIG. 6 is a side elevational view of a third embodiment of the present invention, with portions broken away to reveal another configuration of a muffler.

Another embodiment of the invention is illustrated in FIGS. 4 and 5. Those elements referenced by numbers identical to those in FIGS. 1-3 perform the same or similar function. In the embodiment of FIGS. 4 and 5, the valve 40 operates in the manner discussed above with regard to the embodiment of FIGS. 1-3. During normal operation, the valve 40 directs combustion product entering housing 212 of exhaust processor assembly 210 through the inlet 18 into the first flow passage 28 so that the combustion product from the engine (not shown) passes through substrate 32. When the filter becomes clogged and saturated with solid particles removed from the combustion product, the valve 40 moves to the second valve position, shown in dotted lines in FIG. 4, so that the combustion product is diverted into the second flow passage 30 to bypass substrate 32.

A partition 222 is mounted in housing 212 to divide the interior region of housing 212 adjacent to inlet 18 into first and second flow passages 28 and 30. This partition 222 is shorter in length than the partition 22 illustrated in connection with the embodiment of FIGS. 1-3. Partition 222 includes an inlet cone section 223, a body section 225, and an outlet cone section 227 abutting baffle 77 as shown in FIG. 4.

In the embodiment of FIGS. 4 and 5, the upper shell 14 and lower shell 16 cooperate to define a third flow passage 230 interconnecting the first and second flow passages 28 and 30 and the housing outlet 20. The muffler subassembly 70 extends across the third flow passage 230. As shown best in FIG. 5, muffler subassembly 70 includes dual inlet tubes 72 and an outlet tube 74. In addition, dual unperforated solid vent tubes 76 provide a pair of outlet flow channels to permit combustion product to pass from the substrate 32 through muffler subassembly 70 to the outlet 20 so that the treated combustion product can be exhausted from the housing.

A plurality of baffles 77, 78, and 79 are mounted within housing 212 to secure inlet tubes 72, outlet tube 74, and vent tubes 76 in the predetermined orientation shown in FIG. 5 inside the housing 212 between upper and lower half shells 14 and 16. As shown in FIG. 5, outlet tube 74 is located in substantially the center of housing 212. Dual inlet tubes 72 are situated above the outlet tube 74 and dual vent tubes 76 are situated below outlet tube 74.

The baffles 77, 78, and 79 are configured and located to define an expansion chamber 80, a first resonator chamber 82, and a second resonator chamber 84. The combustion product enters the muffler subassembly 70 and is conducted into expansion chamber 80 via dual inlet tubes 72 and apertures 86 formed therein without communicating with combustion product extant in second resonator chamber 84. The combustion product then enters outlet tube 74 through apertures 88 and is exhausted from the housing through outlet 20. Although the outlet end of tube 74 extends through second resonator chamber 82, the combustion product traveling through tube 74 is not discharged into chamber 82. A portion of the combustion product conducted through second flow passage 30 is discharged into either first resonator chamber 82 through openings 73 in tubes 72 or into second resonator chamber 84 through openings 75 of tube 74. Combustion product can pass from chamber 82 into chamber 84 through chamber 80 via holes 161 formed in baffles 78. Resonator chambers 82 and 84 further attenuate the low frequency components of the combustion product.

In this embodiment, the volume of the muffler subassembly 70 (i.e. chambers 80, 82, and 84) is increased in comparison to the embodiment of FIGS. 1-3 because of the expansion of the space available for muffler 70 between shells 14 and 16 resulting from the shorter length of partition 222 compared to partition 22. Therefore, greater sound attenuation is achieved in the embodiment illustrated in FIGS. 4-5.

Yet another embodiment of the present invention is illustrated in FIG. 6. Those elements referenced by numbers identical to those used in FIGS. 1-5 perform the same or similar function. In this embodiment, exhaust processor assembly 310 includes a lengthened housing 312 to accommodate an additional resonator chamber in the muffler subassembly.

Muffler subassembly 90 inside housing 312 includes dual inlet tubes 92 arranged in a manner similar to that of tubes 72 in FIG. 5 and a single outlet tube 94. Dual vent tubes 96 are likewise arranged in a manner similar to that of tubes 76 in FIG. 5 and permit combustion product exiting substrate 32 to be exhausted from the housing 12 through outlet 20. A plurality of baffles 97, 98, 99, and 101 are used to secure the inlet tubes 92, outlet tube 94, and vent tubes 96 in a predetermined orientation inside the housing 312 between upper and lower half shells 14 and 16. The baffles 97, 98, 99, and 101 are configured and located to define an expansion chamber 100, a first resonator chamber 102, a second resonator chamber 104, and a third resonator chamber 110.

During regeneration of the substrate 32, the combustion product is diverted by valve 40 through second flow passage 30 and enters the muffler 90 through dual inlet tubes 92. The combustion product is conducted into expansion chamber 100 via inlet tubes 92 and the apertures 106 formed therein without communicating with combustion product extant in second resonator chamber 104. The combustion product then enters outlet tube 94 via apertures 108 and is exhausted from the housing 312 through outlet 20. A portion of the combustion product passes the apertures 106 in inlet tubes 92 and enters resonator chamber 102 through opening 93 in tubes 92, and another portion of the combustion product enters resonator chamber 104 through opening 95 in outlet tube 94. Combustion product can pass from chamber 110 into chamber 104 through chamber 102 via holes (not shown) in baffles 98. These holes are similar to holes 161 shown in FIG. 5. The resonator chambers 102 and 104 further attenuate the low frequency components of the combustion product.

Muffler subassembly 90 is also formed to include a third resonator chamber 110. The dual vent tubes 96 are perforated to include a first set of apertures 112 in close proximity to substrate 32 and a second set of apertures 114 in close proximity to outlet 20. A portion of the combustion product exiting substrate 32 and passing through vent tubes 96 enters the second resonator chamber 104 through the first set of apertures 112. In addition, another portion of the combustion product flowing through vent tubes 96 enters the third resonator chamber 110 through the second set of apertures 114. This design also increases the volume of the muffler subassembly 90 for sound attenuation. In this embodiment, reversing the flow of combustion product through the first and second sets of apertures 112 and 114 is possible to utilize the volume in the muffler subassembly 90 to attenuate sound of the exhaust exiting the substrate 32.

Although the invention has been described in detail with reference to certain preferred embodiments, variations and modifications exist within the scope and spirit of the invention as described and defined in the following claims.

What is claimed is:

1. An exhaust processor assembly comprising a housing formed to include an inlet and an outlet, a partition positioned within the housing to define first and second flow passages extending through the housing to provide communication between the inlet and the outlet of the housing, a substrate situated in the first flow passage and configured to collect particulate matter entrained in combustion product introduced into the first flow passage through the inlet, and a muffler situated in the second flow passage to attenuate noise generated by combustion product passing through the second flow passage toward the outlet, the muffler including a plurality of baffles defining a plurality of muffler chambers and at least one tube configured and positioned to interconnect selected muffler chambers to define means for conducting combustion product introduced into the muffler toward the housing outlet.

2. The exhaust processor of claim 1, wherein the muffler extends between the partition and a portion of the housing to traverse the second flow passage.

3. The exhaust processor of claim 1, wherein the housing includes a top shell and a bottom shell, the partition includes a flange trapped between portions of the top and bottom shells to secure the partition in its position within the housing, the partition and the top shell cooperate to define a portion of the second flow passage, and the muffler is situated in said second flow passage portion.

4. The exhaust processor of claim 3, wherein the muffler extends between the partition and the top shell to provide means for reversing the direction of combustion product flow in said portion of the second flow passage to attenuate noise so that noise generated by combustion product in the second flow passage does not exceed a predetermined maximum.

5. An exhaust processor assembly comprising an elongated housing formed to include an inlet and an outlet, the housing including a top shell and a bottom shell, a partition positioned within the housing to define first and second flow passages extending through the housing to provide communication between the inlet and the outlet of the housing, the partition including a flange that is trapped between portions of the top and bottom shells to secure the partition in its position within the housing, the partition and the bottom shell cooperating to define the first flow passage, the partition and the top shell cooperating to define the second flow passage, the partition including an inlet end positioned adjacent the housing inlet and an outlet end positioned midway along the length of the elongated housing, the top and bottom shells cooperating to define a third flow passage therebetween interconnecting the first and second flow passages and the housing outlet, a substrate situated in the first flow passage and configured to collect particulate matter entrained in combustion product introduced into the first flow passage through the inlet, and a muffler situated in the third flow passage to attenuate noise generated by combustion product passing through the third flow passage toward the outlet, the muffler including a plurality of baffles defining a plurality of muffler chambers and at least one tube configured and positioned to interconnect selected muffler chambers to define means for conducting combustion product through the muffler toward the housing outlet.

6. The exhaust processor of claim 5, wherein the plurality of baffles of the muffler interconnect the top and bottom shells to define the plurality of muffler chambers in the third flow passage and the muffler includes a plurality of first tubes arranged to extend through the baffles to define means interconnecting selected muffler chambers for communicating combustion product from the second flow passage to the housing outlet.

7. The exhaust processor of claim 6, wherein the muffler includes a second tube arranged to extend through the baffles to interconnect the first flow passage and the housing outlet without introducing combustion product passing through the first flow passage into any of the muffler chambers.

8. The exhaust processor of claim 6, wherein the muffler further includes a second tube arranged to extend through the baffles to interconnect the first flow passage and the housing outlet and the second tube is formed to include means for communicating combustion product passing therethrough to at least one of the muffler chambers.

9. An exhaust processor assembly comprising a housing including inlet means for introducing combustion product into the housing and outlet means for removing the combustion product from the housing, means located in the first flow passage of the housing for treating the exhaust as the exhaust passes through the first flow passage, means for selectively bypassing the treating means to cause the combustion product introduced into the housing through the inlet means to be diverted from the treating means to a second flow passage, and means located in the second flow passage for attenuating noise generated from the combustion product which bypasses the treating means through the second flow passage, the attenuating means including chamber means for providing a plurality of muffler chambers communicating with the second flow passage and means for conducting combustion product through the plurality of muffler chambers toward the housing outlet.

10. The exhaust processor of claim 9, wherein the housing is elongated and includes a top shell and a bottom shell, the bypassing means includes a partition having a flange trapped between portions of the top and bottom shells to secure the partition in its position within the housing, the partition cooperates with the top shell to define the second flow passage and with the bottom shell to define the first flow passage, the attenuating means includes a plurality of baffles extending between the top shell and the partition configured to define a plurality of muffler chambers in the second flow passage and a plurality of first tubes arranged to extend through the baffles to define means interconnecting selected muffler chambers for communicating combustion product from the second flow passage to the housing outlet.

11. An exhaust processor assembly comprising an elongated housing including inlet means for introducing combustion product into the housing and outlet means for removing the combustion product from the housing, the housing including a top shell and a bottom shell, means located in a first flow passage of the housing for treating the exhaust as the exhaust passes through the first flow passage, means for selectively bypassing the treating means to cause the combustion product introduced into the housing through the inlet means to be diverted from the treating means to a second flow passage, the bypassing means including a partition having a flange trapped between portions of the top and bottom shells to secure the partition in its position within the housing, the partition cooperating with the top shell to define the second flow passage and with the bottom shell to define the first flow passage, the partition extending only midway through the elongated housing, and means situated between the partition and the housing outlet for attenuating noise from the combustion product passing through the housing, the attenuating means including a plurality of baffles configured to define a plurality of muffler chambers in the housing and a plurality of first tubes arranged to extend through the baffles to define means interconnecting selected muffler chambers for communicating combustion product through the muffler chambers toward the housing outlet, the baffles interconnecting the top and bottom shells to increase the volume of the plurality of muffler chambers, thereby increasing the attenuation of noise generated by the combustion product.

12. The exhaust processor of claim 11 wherein the attenuating means further includes at least one vent tube extending through the baffles to interconnect the first flow passage and the housing outlet.

13. The exhaust processor of claim 12, wherein the at least one vent tube is formed to include at least one set of apertures to permit communication between the at least one vent tube and at least one of the muffler chambers to attenuate noise from the combustion product passing from the first flow passage to the outlet means through the at least one vent tube.

14. An exhaust processor assembly comprising a housing including inlet means for introducing a combustion product into the housing and outlet means for exhausting combustion product from the housing, first passageway means for directing flow of the combustion product through a first portion of the housing, second passageway means for directing flow of the combustion product through a second portion of the housing, valve means for selectively directing the combustion product into either the first or second passageway means, means located in the first passageway means for treating the combustion product passing through the first passageway means, and means located in the second passageway means for attenuating noise from the combustion product passing through the second passageway means, the attenuating means including a muffler having a plurality of baffles and a plurality of tubes interconnecting selected baffles to attenuate noise from the combustion product.

15. The assembly of claim 14, wherein the valve means includes a bypass valve to direct the combustion product entering the housing into the first or second passageway means.

16. The assembly of claim 15, wherein the housing includes top and bottom clam shell portions, a partition situated in a predetermined position inside the housing, the partition cooperating with the bottom clam shell and the top clam shell to form the first and second passageway means, respectively, the muffler extending between the partition and the top clam shell to provide means for reversing the direction of combustion product in the second passageway means to attenuate noise so that noise generated by combustion product in the second passageway means does not exceed a predetermined maximum.

17. The assembly of claim 16, wherein the reversing means includes a plurality of baffles interconnecting the top clam shell and the partition to define a plurality of muffler chambers therebetween and at least two tubes configured and positioned to interconnect selected chambers to define means for conducting combustion product through the muffler toward the housing outlet.

18. The assembly of claim 14, wherein the valve means includes a bypass valve to direct the combustion product entering the housing into the first or second passageway means, the housing is elongated and includes top and bottom clam shells to define an inner region of the housing, the muffler extends between the top and bottom clam shells to attenuate noise generated by the combustion product, the muffler having an inlet end situated midway through the elongated housing and an outlet end situated adjacent the housing outlet.

19. The assembly of claim 18, further comprising a partition having an outer flange trapped between portions of the top and bottom clam shells to secure the partition in its position within the housing, the partition having a first end positioned adjacent the housing inlet and a second end connected to the inlet end of the muffler, the partition cooperating with the bottom and top clam shells to define the first and second passageway means, respectively, the plurality of baffles defining a plurality of muffler chambers, and the muffler including a plurality of first tubes arranged to extend through the baffles to define means interconnecting selected muffler chambers for communicating combustion product from the second passageway means to the housing outlet.

20. The assembly of claim 19, wherein the muffler further includes a second tube arranged to extend through the baffles to interconnect the first passageway means and the housing outlet without introducing combustion product passing through the first passageway means into any of the muffler chambers.

21. The assembly of claim 19, wherein the muffler further includes a second tube arranged to extend through the baffles to interconnect the first passageway means and the housing outlet, and the second tube is formed to include means for communicating combustion product passing therethrough to at least one of the muffler chambers.

22. An exhaust processor assembly comprising a housing including inlet means for introducing a combustion product from an engine into the housing and outlet means for exhausting the combustion product from the housing, means for dividing an inner region of the housing into a first flow passage and a second flow passage, each flow passage providing communication between the inlet means and the outlet means, means located in the first flow passage for treating the combustion product, and means located in the second flow passage for acoustically tuning the sound generated by combustion product passing through the second flow passage, the tuning means including a muffler subassembly having at least one inlet tube, at least one outlet tube, means for providing at least one expansion chamber, and means for providing at least one resonator chamber for acoustically tuning the sound generated by combustion product.

23. An exhaust processor assembly comprising a housing including inlet means for introducing combustion product from an engine into the housing and outlet means for exhausting the combustion product from the housing, means for dividing an inner region of the housing into a first flow passage and a second flow passage, the dividing means including a partition positioned inside the housing, the partition cooperating with an inner wall of the housing to define the first and second flow passages, means located in the first flow passage for treating the combustion product, and means situated in the housing between the partition and the outlet for acoustically tuning the sound generated by combustion product passing through the housing, the tuning means including a muffler subassembly having at least one inlet tube, at least one outlet tube, means for providing at least one expansion chamber, and means for providing at least one resonator chamber for acoustically tuning the sound generated by combustion product.

24. The assembly of claim 22, wherein the muffler subassembly traverses the second flow passage.

25. The assembly of claim 24, wherein the first flow passage includes at least one vent tube extending through the muffler subassembly to provide communication between the treating means and the outlet means so that combustion product exiting the treating means can be exhausted through the outlet means.

26. The assembly of claim 25, wherein the at least one vent tube is formed to include at least one set of apertures to permit communication between the at least one vent tube and at least one resonator chamber in the muffler subassembly to attenuate noise from the combustion product passing from the treating means to the outlet means through the at least one vent tube.

27. The assembly of claim 25, wherein the muffler subassembly includes a plurality of baffles configured to define a first resonator chamber and a second resonator chamber, the first resonator chamber is formed to receive a portion of the combustion product from the at least one inlet tube, and the second resonator chamber is formed to receive a portion of the combustion product from the at least one outlet tube, and the at least one inlet tube and at least one outlet tube are formed to include a plurality of apertures to permit communication between the at least one inlet tube and the at least one outlet tube through the expansion chamber so that the combustion product passes from the inlet tube to the outlet tube and is exhausted from the housing through the outlet means.

28. The assembly of claim 27, wherein the at least one vent tube is formed to include a set of apertures to permit communication between the at least one vent tube and the second resonator chamber, thereby attenuating the combustion product passing from the treating means to the outlet means through the at least one vent tube.

29. The assembly of claim 28, wherein the plurality of baffles in the muffler subassembly are configured to define a third resonator chamber, and the at least one vent tube includes a second set of apertures to permit communication between the at least one vent tube and the third resonator chamber to further attenuate the combustion product passing from the treating means to the outlet means through the at least one vent tube.

* * * * *